US008943698B2

(12) United States Patent
Hirai

(10) Patent No.: US 8,943,698 B2
(45) Date of Patent: Feb. 3, 2015

(54) KITCHEN KNIFE WITH SHARPENER

(75) Inventor: Akira Hirai, Saitama-ken (JP)

(73) Assignee: Forever Co., Ltd. (JP)

( * ) Notice: Subject to any disclaimer, the term of this patent is extended or adjusted under 35 U.S.C. 154(b) by 0 days.

(21) Appl. No.: 13/527,646

(22) Filed: Jun. 20, 2012

(65) Prior Publication Data

US 2013/0205597 A1 Aug. 15, 2013

(30) Foreign Application Priority Data

Feb. 13, 2012 (JP) ..... 2012-000725 U

(51) Int. Cl.
*B25F 3/00* (2006.01)
*B26B 11/00* (2006.01)
*B24D 15/08* (2006.01)

(52) U.S. Cl.
USPC ..... 30/138; 76/82

(58) Field of Classification Search
USPC ..... 30/138; 76/82
See application file for complete search history.

(56) References Cited

U.S. PATENT DOCUMENTS 1,359,448 A * 11/1920 Stodder ..... 30/138
1,477,488 A * 12/1923 Holland ..... 30/138
1,732,705 A * 10/1929 Whittemore ..... 30/138
2,295,859 A * 9/1942 Murray ..... 451/558
2,700,819 A * 2/1955 Mason ..... 30/138
2,767,530 A * 10/1956 Paldanius ..... 451/555
4,428,515 A * 1/1984 Mayer ..... 224/232
4,494,340 A * 1/1985 Carter ..... 451/555
4,502,218 A * 3/1985 Carter et al. ..... 30/138
5,163,251 A * 11/1992 Lee ..... 451/555
5,449,315 A * 9/1995 Friel ..... 451/282
5,605,495 A * 2/1997 Jenkins, Jr. ..... 451/45
7,337,545 B2 * 3/2008 Miltner et al. ..... 30/138
8,221,199 B2 * 7/2012 Smith ..... 451/552

FOREIGN PATENT DOCUMENTS

JP 3021710 3/1996
JP 2004-229744 8/2004
JP 2007-195734 8/2007
JP 2008-173155 7/2008

* cited by examiner

*Primary Examiner* — Hwei C Payer
(74) *Attorney, Agent, or Firm* — Schwegman Lundberg & Woessner, P.A.

(57) ABSTRACT

The kitchen knife with the sharpener includes: a cutout recess formed in an end of the handle; a locking space extending from the cutout recess; and a sharpener, including: a locking part removably received in the locking space; a sharpener body extending from the locking part; a whetting groove transversely formed in the sharpener body; plate-shaped whetstones inclinedly installed on opposing sidewalls of the whetting groove so that the whetstones form a V-shaped arrangement; and a rubber cushion placed below a rear surface of a whetstone.

2 Claims, 3 Drawing Sheets

KITCHEN KNIFE WITH SHARPENER

CROSS REFERENCE TO RELATED APPLICATION(S)

This application claims the benefit of priority under 35 U.S.C. §119 of Akira Hirai, Utility Model Application No. JP 2012-000725 U, filed on Feb. 13, 2012, entitled "KITCHEN KNIFE WITH SHARPENER," the benefit of priority of which is claimed hereby and which is incorporated by reference in its entirety into this application.

BACKGROUND OF THE INVENTION

1. Technical Field

The present invention relates generally to a kitchen knife with a sharpener and, more particularly, to a kitchen knife with a sharpener, which is configured to allow a user to quickly take the sharpener from out of the knife when a cutting edge of the knife becomes dull and requires to be whetted.

2. Description of the Related Art

Kitchen knives are generally used in the home and restaurants. The kinds of kitchen knives and the materials from which they are made have undergone various developments no that the kitchen knives are helpful to living and work. Further, a variety of whetstones have been made available to appropriately whet the cutting edges of a variety of kitchen knives having different blade materials so that it is not good to whet the various kitchen knives using one whetstone.

In other words, kitchen knives that are made of steel or stainless steel have relatively low hardness and the sharp cutting edges of the steel or stainless steel kitchen knives easily and quickly become dull as the knives are used with the passage of time, so that it is necessary to frequently whet the cutting edges using natural whetstones or artificial whetstones so as to recover the desired sharpness. Further, when the cutting edge of a kitchen knife is made of a super hard material, the cutting edges can maintain the desired sharpness for a lengthy period of time and so the cutting edge of the kitchen knife may be made of a super hard material, such as ceramic, titanium or titanium alloy. However, when the cutting edge of a kitchen knife that is made of a super hard material loses its edge and becomes dull, general natural whetstones or general artificial whetstones cannot be used to recover the sharpness of the cutting edge so that one must whet the cutting edge made of a super hard material using a special whetstone and users of such a kitchen knife should entrust manufacturers or whetting experts with the Whetting work. Further, a special whetstone may be attached to a kitchen knife when a user purchases the kitchen knife. However, the attached special whetstone may easily be lost or the place where the whetstone is located may not be easy to discover because the whetstone is not frequently used.

For example, the inventor of this invention already proposed a folding cutter, which is configured in such a way that a blade 1 can be received in a handle 3 by folding the blade 1. In this folding cutter, a whetstone plate 4 that is supported by an elastic member 5 is placed in the handle 3 at an angle at a location through which a cutting edge 1*a* of the blade 1 passes when the blade 1 is received into the handle 3. Therefore, when the blade 1 is received into the handle 3, the cutting edge 1*a* comes into sliding contact with the inclined whetstone plate 4 so that the cutting edge 1*a* can be whetted easily and semiautomatically by the whetstone plate 4 (see patent document 1). Further, a technique, which uses a whetstone plate angle changing device 6 that can change the contact angle between the whetstone plate 4 and the cutting edge 1*a* or can bring both the whetstone plate 4 and the cutting edge 1*a* into a noncontact state, was proposed is patent document 1. Further, another technique, which has a handle 3 that is provided with a cutout pocket 3*a*, a pocket sleeve 4 that is embedded in the cutout pocket 3*a*, and a sharpener body 5 that is removably received in the pocket sleeve 4 and includes a diamond sharpener 5*a* and finger grips 5*c* provided on the diamond sharpener 5*a*, was proposed (see patent document 2). In the technique disclosed in patent document 2, the pocket sleeve 4 is embedded in the cutout pocket 3*a* and the sharpener body 5 is removably received in the pocket sleeve 4 in such a way that the finger grips 5*c* are exposed outside opposite side surfaces of the handle 3. Here, the knife blade is made of super hard ceramic or tungsten carbide having an HIV value of 1000 or higher. A further technique was proposed (see patent document 3) in which a sleeve is embedded in a cutter body and both a polishing material and a whetstone are attached to an end of the sleeve so that, when a cutter blade is ejected from or retracted into the cutter body, a cutting edge of the blade can be whetted both by the polishing material and by the whetstone, thereby maintaining the knife in a sharp state. This patent document 3 also discloses forming a slit in a conventional dull piece removing part that is provided in the rear end of the cutter body so that a dull piece from the blade can be removed by bending the dull piece and both a polishing material and a whetstone are attached in the slit. Therefore, it is possible to further whet the cutting edge using both the polishing material and the whetstone, thereby increasing the expected lifespan of the cutting edge and increasing the economical value of the cutter. Yet another technique, which provides an edged tool X having a blade 1, a handle 2 that holds the blade 1 and a whetstone 3 that is removably received in the handle 2, was proposed (see patent document 4). In the technique disclosed in patent document 4, at least one of opposite side surfaces 21*a* and 21*b* of the handle 2 that are opposed to each other relative to a transverse directional axis L of the blade 1 is totally or partially inclined relative to the transverse directional axis L of the blade 1, thus forming an inclined surface, so that, when a cutting edge 13 of the blade 1 must be whetted using the whetstone 3, the handle 2 is placed on a support table 5 in such a way that the inclined side surface of the handle 2 comes into contact with an upper surface 51 of the support table 5. Therefore, the blade 1 can be naturally placed at an angle on the support table so that the blade 1 is tilted upwards in a direction from the back of a blade 14 to the cutting edge 15.

DOCUMENTS OF RELATED ART (Patent Document 1) Japanese Patent Application Publication No. 2007-195734;

(Patent Document 2) Japanese Patent Application Publication No. 2008-173155;

(Patent Document 3) Japanese Utility Model Registration No. 3021710; and (Patent Document 4) Japanese Patent Application Publication No. 2004-229744.

SUMMARY OF THE INVENTION

The technique disclosed in patent document 1 proposed a folding cutter, in which the blade 1 can be received into the handle 3 by folding the blade 1 and the cutting edge of the blade 1 can be automatically whetted by the whetstone plate 4 when the blade 1 is put in the handle. However, this technique is problematic in that it is impossible to desirably whet the cutting edge to make the cutting edge very sharp. Further, the technique disclosed in patent document 2 proposed an edged tool, in which the diamond sharpener body 5 can be removably received in the cutout pocket 3*a* of the handle 3. However, this technique is problematic in that it is designed to be used exclusively with a knife blade that is made of a special material, such as super hard ceramic or tungsten carbide having an HV value of 1000 or higher. Further, the diamond sharpener is a plate type sharpener that requires a high degree of whetting skill. Further, patent document 3 proposed the technique in which a slit is formed in the conventional dull piece removing part that is used to remove a dull piece from the blade by bending the dull piece, and both the polishing material and the whetstone are attached in the slit so as to whet the cutting edge. However, this technique is problematic in that the structure for realizing the operation is not disclosed in patent document 3 and it is very difficult to make the angle of the cutting edge and the whetting angle of both the polishing material and the whetstone equal to each other. Further, the technique disclosed in patent document 4 proposed the detachable whetstone 3 that is provided in the handle 2. However, this technique is problematic in that it is necessary to make the angle of the side surface of the handle 2 and the angle of the cutting edge 15 equal to each other, so that it is very difficult to put this technique into practice.

Accordingly, the present invention has been made keeping in mind the above problems occurring in the prior art, and an object of the present invention is to provide a kitchen knife with a sharpener, including: a knife blade having a cutting edge that is formed along a longitudinal edge of the knife blade, and a handle, into which a blade tang of the knife blade is inserted so as to be fixed, further including: a cutout recess formed in an end of the handle by cutting opposite lateral surfaces of the end of the handle so as to form a laid U shaped cutout recess; a locking space formed in the handle in such a way that the locking space extends from an inside end of the cutout recess and defines a hollow chamber having a rectangular cross-section; and a sharpener, including: a locking part, a shank of which has a rectangular shape, the locking part being removably received in the locking space of the handle; a sharpener body extending from the locking part in such a way that an end bottom surface and opposite lateral surfaces of the sharpener body are exposed outside the handle; a whetting groove transversely formed in the sharpener body; plate-shaped whetstones inclinedly installed on opposing sidewalls of the whetting groove at predetermined inclination angles so that the whetstones form a V-shaped arrangement; and a rubber cushion placed below a rear surface of the whetstone that is installed on at least one of the opposing sidewalls of the whetting groove. Further, the present invention is to provide a kitchen knife with a sharpener, in which the sharpener includes two whetting grooves transversely formed in a parallel arrangement in the sharpener body; plate-shaped first whetstones for conducting first whetting, the plate-shaped first whetstones being inclinedly installed on opposing sidewalls of one of the two whetting grooves at predetermined inclination angles so that the first whetstones form a V-shaped arrangement; plate-shaped finishing whetstones for conducting finish whetting, the plate-shaped finishing whetstones inclinedly installed on opposing sidewalls of a remaining one of the two whetting grooves at predetermined inclination angles so that the finishing whetstones form a V-shaped arrangement; and rubber cushions respectively placed below a rear surface of the first whetstone that is installed on at least one of the opposing sidewalls of the one of the two whetting grooves and placed below a rear surface of the finishing whetstone that is installed on at least one of the opposing sidewalls of the remaining one of the two whetting grooves.

The kitchen knife with the sharpener according to the present invention is advantageous in that the sharpener that is designed to efficiently whet the cutting edge of the knife blade according to the material of the blade is received in the handle of the knife in such a way that the finger grips of the sharpener are exposed outside the handle so that, when it is required to whet the cutting edge, a user can easily and quickly take the sharpener out of the handle while holding the sharpener with the fingers on the finger grips and, accordingly, the user can instantly whet the cutting edge when necessary. Further, at least one whetting groove is transversely formed in the sharpener body and whetstones are inclinedly installed on the opposing sidewalls of the whetting groove in such a way that the whetstones can form a V-shaped arrangement, in which the whetstones are inclined relative to a vertical axis at predetermined inclination angles. Therefore, when it is required to whet the cutting edge, the user inserts the cutting edge of the blade into the V-shaped crevice between the whetstones that are installed in the whetting groove, and repeatedly moves the blade back and forth along the crevice while holding the locking part of the sharpener with the hand, thereby easily whetting the cutting edge until the desired sharpness of the cutting edge is recovered. Further, a rubber cushion may be placed below the rear surface of a whetstone that is installed on at least one of the opposing sidewalls of the whetting groove or rubber cushions may be respectively placed below the rear surface of a first whetstone that is used to perform first whetting and is installed on at least one of the opposing sidewalls of a first whetting groove and placed below the rear surface of a finishing whetstone that is used to perform finish whetting and is installed on at least one of the opposing sidewalls of a second whetting groove, so that the rubber cushions can efficiently absorb a load that is applied to the whetstones when doing whetting work and can correct an unbalanced whetting angle. Therefore, the kitchen knife with the sharpener according to the present invention allows a user to easily whet the cutting edge of the blade regardless of whetting skill until a desired sharpness of the cutting edge is recovered.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
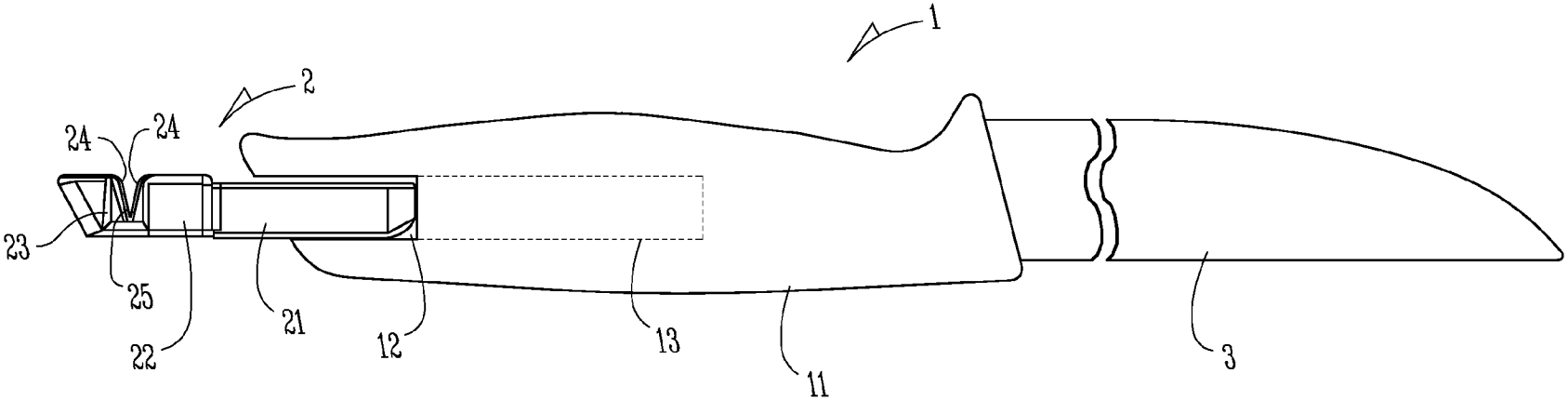
FIG. 1 is a side view of a kitchen knife in combination with a sharpener according to a first embodiment of the present invention.
Figure 2:
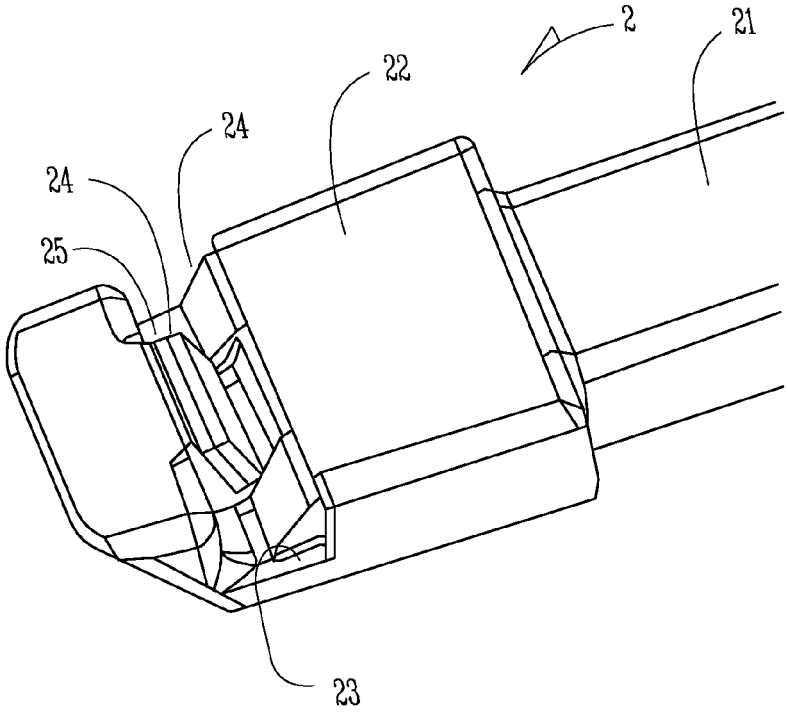
FIG. 2 is a perspective view of the sharpener according to the first embodiment of the present invention.

Hereinbelow, preferred embodiments of a kitchen knife with a sharpener according to the present invention will be described with reference to the accompanying drawings. FIG. 1 is a side view of a kitchen knife with a sharpener according to a first embodiment of the present invention. FIG. 2 is a perspective view of the kitchen knife with the sharpener according to the first embodiment of the present invention.

Figure 3:
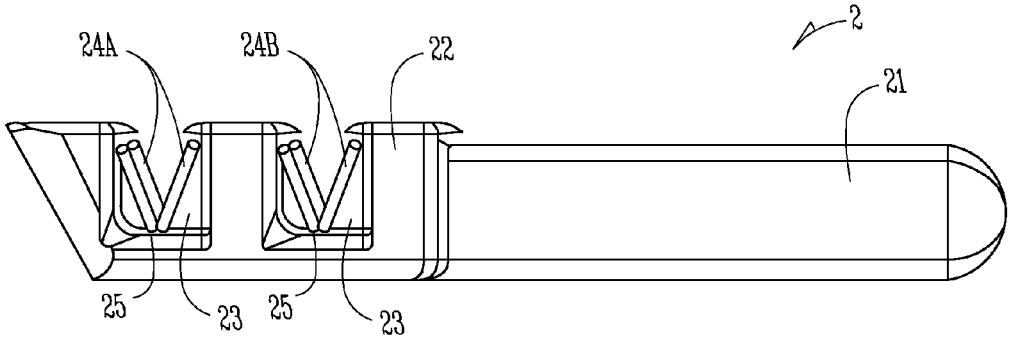
FIG. 3 is a side view of the sharpener according to a second embodiment of the present invention.

FIG. 3 is a side view of a kitchen knife with a sharpener according to a second embodiment of the present invention.

The present invention relates to a kitchen knife with a sharpener and, more particularly, to a kitchen knife with a sharpener, which is configured to allow a user to quickly take the sharpener out of the knife when a cutting edge of the knife becomes dull and requires to be whetted. The kitchen knife 1 with the sharpener includes: a knife blade (3) having a cutting edge that is formed along a longitudinal edge of the knife blade, and a handle 11, into which a blade tang of the knife blade is inserted so as to be fixed, and further includes: a cutout recess 12 formed in an end of the handle 11 by cutting opposite lateral surfaces of the end of the handle so as to form a cutout recess; a locking space 13 formed in the handle 11 in such a way that the locking space extends from an inside end of the cutout recess 12 and defines a hollow chamber having a rectangular cross-section; and a sharpener, including: a locking part 21, a shank of which has a rectangular shape, the locking part being removably received in the locking space 13 of the handle; a sharpener body 22 extending from the locking part 21 in such a way that an end bottom surface and opposite lateral surfaces of the sharpener body are exposed outside the handle 11; a whetting groove 23 transversely formed in the sharpener body 22; plate-shaped whetstones 24 inclinedly installed on opposing sidewalls of the whetting groove 23 at predetermined inclination angles so that the whetstones form a V-shaped arrangement; and a rubber cushion 25 placed below a rear surface of the whetstone 24 that is installed on at least one of the opposing sidewalls of the whetting groove.

The kitchen knife 1 with the sharpener includes: a knife blade having a cutting edge that is formed along a longitudinal edge of the knife blade, and a handle 11, into which a blade tang of the knife blade is inserted so as to be fixed, and further includes: a cutout recess 12 formed in an end of the handle 11 by cutting opposite lateral surfaces of the end of the handle so as to form a cutout recess; a locking space 13 formed in the handle 11 in such a way that the locking space extends from an inside end of the cutout recess 12 and defines a hollow chamber having a rectangular cross-section; and a sharpener, including: a locking part 21, a shank of which has a rectangular shape, the locking part being removably received in the locking space 13 of the handle; a sharpener body 22 extending from the locking part 21 in such a way that an end bottom surface and opposite lateral surfaces of the sharpener body are exposed outside the handle 11; two whetting grooves 23 transversely formed in a parallel arrangement in the sharpener body 22; plate-shaped first whetstones 24*a* for conducting first whetting, the plate-shaped first whetstones being inclinedly installed on opposing sidewalls of one of the two whetting grooves 23 at predetermined inclination angles so that the first whetstones form a V-shaped arrangement; plate-shaped finishing whetstones 24*b* for conducting finish whetting, the plate-shaped finishing whetstones inclinedly installed on opposing sidewalls of a remaining one of the two whetting grooves 23 at predetermined inclination angles so that the finishing whetstones form a V-shaped arrangement; and rubber cushions 25 respectively placed below a rear surface of the first whetstone 24*a* that is installed on at least one of the opposing sidewalls of the one of the two whetting grooves and placed below a rear surface of the finishing whetstone 24*b* that is installed on at least one of the opposing sidewalls of the remaining one of the two whetting grooves.

Embodiments

Described in detail, a kitchen knife 1 according to a first embodiment of the present invention includes a knife blade, in which a sharp cutting edge is formed along a longitudinal edge of the blade so as to cut food, a blade tang that has a flat shape and integrally extends from a base of the knife blade, and a handle 11, into a front end of which the tang is inserted to fix the tang to the handle 11. The handle 11 is oval in cross-section so that a user can easily and firmly grip the handle 11. Provided in a rear end of the handle 11 is a sharpener holding recess for holding a sharpener 2 that will be described later herein.

As shown in FIG. 1, to form the sharpener holding recess in the handle 11, a cutout recess 12 is formed in the rear end of the handle 11 by axially cutting opposite lateral surfaces of the rear end of the handle 11 to a predetermined depth so as to form a cutout recess which is open to the outside and opposite sides thereof so that the cutout recess 12 defines a space for receiving a sharpener body 22 that will be described later herein.

Further, a locking space 13 is axially formed in the handle 11 in such a way that the locking space 13 defines a hollow chamber having a rectangular cross-section. Here, the locking space 13 axially extends inwardly from an inside end of the cutout recess 12 and receives and removably holds a locking part 21 of the sharpener 2 therein. In the present invention, the locking space 13 may have a variety of locking structures that can receive and removably hold the locking part 21 of the sharpener 2.

The shank of the locking part 21 of the sharpener 2 has a rectangular shape and is removably received and held in the locking space 13 of the handle 11. Here, the locking part 21 of the sharpener 2 may have a variety of locking structures that can be received and removably held in the locking space 13 of the handle 11, the locking structures not allowing the locking part 21 to be easily or unexpectedly removed from the space 13.

As shown in FIG. 1, the sharpener 2 further includes the sharpener body 22 that integrally extends from the locking part 21. Here, the sharpener 2 is received and held in the handle 11 in such a way that the end bottom surface and opposite lateral surfaces of the sharpener body 22 are placed in the rear end surface and opposite lateral surfaces of the handle 11 so as to be even with the respective surfaces of the handle 11 and exposed to the outside by the respective surfaces of the handle 11. In other words, when the sharpener body 22 is received in the handle 11, the end bottom surface and opposite lateral surfaces of the sharpener body 22 coincide with the rear end surface and opposite lateral surfaces of the handle 11, respectively. Further, a finger grip is formed on each of the opposite lateral surfaces of the sharpener body 22 so as to allow a user to easily handle the sharpener body 22 using fingers when the user takes the sharpener body 22 out of the handle 11.

Further, a whetting groove 23 is transversely formed on an upper surface of the sharpener body 22 and whetstones 24 that will be described later herein are seated in the whetting groove 23. Here, opposite ends of the whetting groove 23 form respective inclined surfaces so that water can be easily drained from the groove 23 without collecting therein.

The whetstones 24 are plate-shaped whetstones and are installed at an angle on opposing sidewalls of the whetting groove 23 in such a way that the whetstones 24 can form a V-shaped arrangement, in which the whetstones 24 are inclined relative to a vertical axis at predetermined inclination angles. To allow a user to perform whetting work efficiently, one whetstone is installed on a middle portion of a first sidewall of the whetting groove 23 and two whetstones are installed on opposite sides of a second sidewall of the whetting groove no that the two whetstones on the opposite sides of the second sidewall of the whetting groove are transversely offset from the middle whetstone. In other words, as shown in FIG. 2, the whetstones 24 are installed in the whetting groove 23 in such a way that one whetstone is inclinedly placed in the middle portion of the first sidewall of the whetting groove 23 and two whetstones are inclinedly placed in the opposite sides of the second sidewall of the whetting groove so that the opposite side whetstones are offset from the middle whetstone and the middle and opposite side whetstones form a V-shaped arrangement when they are viewed from a side of the sharpener body 22.

Further, a rubber cushion 25 that is made of elastic and flexible rubber is placed below the rear surface of a whetstone 24 that is installed on at least one of the opposing sidewalk of the whetting groove 23. However, it should be understood that the rubber cushion 25 may be placed below the rear surface of each of the whetstones 24 that are placed on the opposite sidewalls of the whetting groove 23.

When the cutting edge of the kitchen knife must be whet using the sharpener of the present invention, a user takes the sharpener 2 out of the sharpener holding recess of the handle 11 and inserts the cutting edge of the blade of the knife 1 into a V-shaped crevice between the whetstones 24 that are installed in the whetting groove 23, and repeatedly moves the blade forwards and backwards along the crevice while holding the locking part 21 of the sharpener 2 with the hand, thereby easily whetting the cutting edge until the desired sharpness of the cutting edge is recovered. After finishing the whetting work, the sharpener 2 is received in the sharpener holding recess of the handle 11.

In a second embodiment of the present invention, two whetting grooves 23 are transversely formed on the upper surface of the sharpener body 22 in such a way that the two whetting grooves 23 are parallel to each other. First whetstones 24*a* for conducting first whetting are installed in one of the two whetting grooves 23 and finishing whetstones 24*b* for conducting finish whetting are installed in the other whetting groove 23, as shown in FIG. 3, so that a user can perform first whetting work using the first whetstones 24*a* and then performs finish whetting work using the finishing whetstones 24*b*. In the second embodiment, the general shape of the sharpener 2 remains the same as in the first embodiment, but the two whetting grooves 23 are formed in the sharpener body 22 and first and finishing whetstones 24*a* and 24*b* are installed in respective whetting grooves 23 so as to allow the user to perform the first whetting and the finish whetting. Therefore, further explanation of the construction of the sharpener 2 according to the second embodiment is not necessary.

As described above, the present invention provides the kitchen knife with the sharpener, in which the sharpener that is designed to efficiently whet the cutting edge of the knife blade according to the material of the blade is received in the handle of the knife in such a way that the finger grips of the sharpener are exposed outside the handle so that, when it is required to whet the cutting edge, a user can easily and quickly take the sharpener out of the handle while holding the sharpener with the fingers on the finger grips and, accordingly, the user can instantly whet the cutting edge when necessary. Further, at least one whetting groove is transversely formed in the sharpener body and whetstones are inclinedly installed on the opposing sidewalls of the whetting groove in such a way that the whetstones can form a V-shaped arrangement, in Which the whetstones are inclined relative to a vertical axis at predetermined inclination angles. Therefore, when it is required to whet the cutting edge, the user inserts the cutting edge of the blade into the V-shaped crevice between the whetstones that are installed in the whetting groove, and repeatedly moves the blade back and forth along the crevice while holding the locking part of the sharpener with the hand, thereby easily whetting the cutting edge until the desired sharpness of the cutting edge is recovered. Further, a rubber cushion may be placed below the rear surface of a whetstone that is installed on at least one of the opposing sidewalls of the whetting groove or rubber cushions may be respectively placed below the rear surface of a first whetstone that is used to perform first whetting and is installed on at least one of the opposing sidewalls of a first whetting groove and placed below the rear surface of a finishing whetstone that is used to perform finish whetting and is installed on at least one of the opposing sidewalls of a second whetting groove, so that the rubber cushions can efficiently absorb a load that is applied to the whetstones when doing whetting work and can correct an unbalanced whetting angle. Therefore, the kitchen knife with the sharpener according to the present invention allows a user to easily whet the cutting edge of the blade regardless of whetting skill until a desired sharpness of the cutting edge is recovered.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A kitchen knife in combination with a sharpener, said kitchen knife comprising:

a blade and a handle;

a cutout recess formed in an end of the handle by cutting opposite lateral surfaces of the end of the handle so as to form the cutout recess;

a locking space formed in the handle in such a way that the locking space extends from an inside end of the cutout recess and defines a hollow chamber having a rectangular cross-section; and said sharpener, comprising:

a locking part, a shank of which has a rectangular shape, the locking part being removably received in the locking space of the handle;

when the sharper is received in the handle, a sharpener body extends from the locking part in such a way that an end bottom surface and opposite lateral surfaces of the sharpener body are exposed outside the handle;

a whetting groove transversely formed in the sharpener body;

plate-shaped whetstones inclinedly installed on opposing sidewalls of the whetting groove at predetermined inclination angles so that the whetstones form a V-shaped arrangement; and a rubber cushion placed below a rear surface of the whetstone that is installed on at least one of the opposing sidewalls of the whetting groove.

2. A kitchen knife in combination with a sharpener, the kitchen knife comprising:

a blade and a handle;

a cutout recess formed in an end of the handle by cutting opposite lateral surfaces of the end of the handle so as to form the cutout recess;

a locking space formed in the handle in such a way that the locking space extends from an inside end of the cutout recess and defines a hollow chamber having a rectangular cross-section; and said sharpener, comprising:

a locking part, a shank of which has a rectangular shape, the locking part being removably received in the locking space of the handle;

when the sharper is received in the handle, a sharpener body extends from the locking part in the handle in such a way that an end bottom surface and opposite lateral surfaces of the sharpener body are exposed outside the handle;

two whetting grooves transversely formed in a parallel arrangement in the sharpener body;

plate-shaped first whetstones for conducting first whetting, the plate-shaped first whetstones being inclinedly installed on opposing sidewalls of one of the two whetting grooves at predetermined inclination angles so that the first whetstones form a V-shaped arrangement;

plate-shaped finishing whetstones for conducting finish whetting, the plate-shaped finishing whetstones inclinedly installed on opposing sidewalls of a remaining one of the two whetting grooves at predetermined inclination angles so that the finishing whetstones form a V-shaped arrangement; and rubber cushions respectively placed below a rear surface of the first whetstone that is installed on at least one of the opposing sidewalls of the one of the two whetting grooves and placed below a rear surface of the finishing whetstone that is installed on at least one of the opposing sidewalls of the remaining one of the two whetting grooves.

* * * * *